US010036977B2

(12) United States Patent
Ono

(10) Patent No.: US 10,036,977 B2
(45) Date of Patent: Jul. 31, 2018

(54) IMAGE FORMING APPARATUS

(71) Applicant: CANON KABUSHIKI KAISHA, Tokyo (JP)

(72) Inventor: Kazuaki Ono, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/955,238

(22) Filed: Dec. 1, 2015

(65) Prior Publication Data

US 2016/0161883 A1 Jun. 9, 2016

(30) Foreign Application Priority Data

Dec. 9, 2014 (JP) ..... 2014-248551

(51) Int. Cl.
*G03G 15/06* (2006.01)
*G03G 15/08* (2006.01)
*G03G 15/00* (2006.01)

(52) U.S. Cl.
CPC ..... *G03G 15/0822* (2013.01); *G03G 15/065* (2013.01); *G03G 15/5008* (2013.01); *G03G 15/5029* (2013.01); *G03G 15/6594* (2013.01); *G03G 15/5095* (2013.01); *G03G 2215/00734* (2013.01)

(58) Field of Classification Search
CPC ..... G03G 15/065; G03G 15/0822; G03G 15/5008; G03G 15/5029; G03G 15/5095; G03G 2215/00075
See application file for complete search history.

(56) References Cited

U.S. PATENT DOCUMENTS

| | | | |
|---|---|---|---|
| 5,095,341 | A | 3/1992 | Yoshida et al. |
| 7,231,168 | B2 | 6/2007 | Hirobe |
| 7,873,289 | B2 | 1/2011 | Shin |
| 8,437,649 | B2 | 5/2013 | Ochi et al. |
| 8,774,660 | B2 | 7/2014 | Fujishima |
| 8,824,906 | B2 | 9/2014 | Ishihara et al. |

(Continued)

FOREIGN PATENT DOCUMENTS

| | | |
|---|---|---|
| CN | 1841228 | 10/2006 |
| CN | 101324766 A | 12/2008 |

(Continued)

OTHER PUBLICATIONS

Chinese Office Action dated Sep. 5, 2017, in related Chinese Patent Application No. 201510885504.0 (with English translation).

*Primary Examiner* — Joseph S Wong
(74) *Attorney, Agent, or Firm* — Fitzpatrick, Cella, Harper & Scinto

(57) ABSTRACT

Provided is an image forming apparatus including an image bearing member, a developing device, a bias applying portion, a driving portion, a transfer device, and a controller. In a case where the length of the recording material is a second length larger than a first length, the controller controls the speed ratio of the driving speed of the developer bearing member to the image bearing member to be a second speed ratio larger than a first speed ratio and controls the residual developer amount born per unit area of the developer bearing member after the developing of the electrostatic image becomes a second developer amount larger than a first developer amount.

47 Claims, 3 Drawing Sheets

(56) References Cited

U.S. PATENT DOCUMENTS

| | | | | |
|---|---|---|---|---|
| 2011/0058831 | A1* | 3/2011 | Usami | G03G 15/1645 399/46 |
| 2011/0222878 | A1 | 9/2011 | Ochi et al. | |
| 2013/0022365 | A1 | 1/2013 | Fujishima | |
| 2013/0243454 | A1 | 9/2013 | Ishihara et al. | |

FOREIGN PATENT DOCUMENTS

| | | | |
|---|---|---|---|
| EP | 2 645 173 | A1 | 10/2013 |
| EP | 2 645 173 | B1 | 8/2014 |
| JP | H02-245778 | A | 10/1990 |
| JP | H08-297413 | A | 11/1996 |
| JP | H10-090960 | A | 4/1998 |
| JP | 2005-189279 | A | 7/2005 |
| JP | 2008-310368 | A | 12/2008 |
| JP | 2009-258432 | A | 11/2009 |
| JP | 4636293 | B2 | 2/2011 |
| JP | 2011-191531 | A | 9/2011 |
| JP | 2013-025061 | A | 2/2013 |
| JP | 2013-114252 | A | 6/2013 |
| JP | 2013-190722 | A | 9/2013 |
| JP | 5539929 | B2 | 7/2014 |
| JP | 5661059 | B2 | 1/2015 |
| JP | 5724195 | B2 | 5/2015 |

* cited by examiner

IMAGE FORMING APPARATUS

BACKGROUND OF THE INVENTION

Field of the Invention

The present invention relates to an image forming apparatus changing a circumferential speed ratio of a developer bearing member to an image bearing member to reduce a variation in image density of a long sheet.

Description of the Related Art

In POP (point of purchase) advertisement as an advertising medium for sales promotion mainly used in shops, due to a high printing ratio, a solid image or a long sheet such as a recording material of which length is in a range of 900 mm to 1200 mm is used. If a solid image is printed on such a long sheet, there occurs a problem in that an image density is lowered in a latter half of the image. This problem is a phenomenon occurring when a consumed amount of the toner on the surface of the developing roller is large and, thus, a supplied amount of the toner to the developing roller is insufficient.

As measures to the problem, the inventor of the present invention found that an image density stability of the long sheet can be secured by lowering the developing efficiency by an electric field and increasing a circumferential speed ratio of the developing roller to a photosensitive drum. Herein, configurations of changing the circumferential speed ratio of the developing roller to the photosensitive drum are disclosed in the following documents.

Japanese Patent Laid-Open No. 2-245778 discloses a configuration of changing modes by using an electronic clutch so that in a period of a character (standard) mode, a hard contrast image is formed by setting a rotation speed of the developing roller to be high, and in a period of a picture mode, a soft contrast image is formed by setting the rotation speed of the developing roller to be low. According to this configuration, a small-sized, low-cost image forming apparatus can be provided.

Japanese Patent Laid-Open No. 2005-189279 discloses a configuration of detecting the number of times of image formation and changing a rotation speed of a developing sleeve. According to this configuration, a stabilized image can be provided irrespective of the number of times of image formation.

As the other related arts, in a developing system for a liquid developer, a configuration of changing the rotation number of a developing roller based on a type of a recording material is disclosed. According to this configuration, a uniform developer density can be obtained.

In addition, as the other related arts, a configuration of changing a rotation speed of a developing roller based on a detection value of a toner density detection portion is disclosed. According to this configuration, an appropriate toner density is maintained.

However, in the inventions of Japanese Patent Laid-Open No. 2-245778 and No. 2005-189279, and the other related arts, there is no mention about a density stability of a solid image on a long sheet. Herein, a developing efficiency by an electric field is allowed to be lowered, and a consumed amount of toner on the surface of the developing roller is allowed to be decreased. By doing so, a residual toner amount on the surface of the developing roller is increased, and a circumferential speed ratio of the developing roller to the photosensitive drum is increased, so that a supplied amount of toner to the surface of the developing roller is increased. As a result, the problem in that the image density is lowered in the latter half of the image of the long sheet can be alleviated, so that a uniform image on the recording material can be obtained.

On the other hand, if the circumferential speed ratio of the developing roller to the photosensitive drum is increased, the abrasion of the photosensitive drum or the developing roller is increased, so that there occurs a problem in that the life cycle of the photosensitive drum or the developing roller is shortened.

SUMMARY OF THE INVENTION

It is desirable to provide an image forming apparatus capable of stabilizing an image density of a long sheet over an area of a former half of an image to a latter half of the image and of extending a life cycle of an image bearing member and a life cycle of a developer bearing member.

An image forming apparatus comprising:

an image bearing member;

a developing device which includes a developer bearing member configured to face the image bearing member and configured to bear a developer and develop an electrostatic image formed on the image bearing member with the developer;

a bias applying portion configured to apply a developing bias to the developer bearing member;

a driving portion configured to drive the developer bearing member;

a transfer device configured to transfer an image developed by the developer bearing member to the recording material; and a controller configured to control a driving speed of the developer bearing member and the developing bias based on a length of the recording material in a recording material conveying direction, wherein, in a case where the length of the recording material in the recording material conveying direction is a first length, the controller controls a speed ratio of the driving speed of the developer bearing member to a driving speed of the image bearing member to be a first speed ratio and controls the developing bias so that a residual developer amount born per unit area of the developer bearing member after the developing of the electrostatic image becomes a first developer amount, and wherein, in a case where the length of the recording material in the recording material conveying direction is a second length larger than the first length, the controller controls the speed ratio of the driving speed of the developer bearing member to the driving speed of the image bearing member to be a second speed ratio larger than the first speed ratio and controls the residual developer amount born per unit area of the developer bearing member after the developing of the electrostatic image becomes a second developer amount larger than the first developer amount.

Further features of the present invention will become apparent from the following description of exemplary embodiments with reference to the attached drawings.

DESCRIPTION OF THE EMBODIMENTS

Figure 1A:
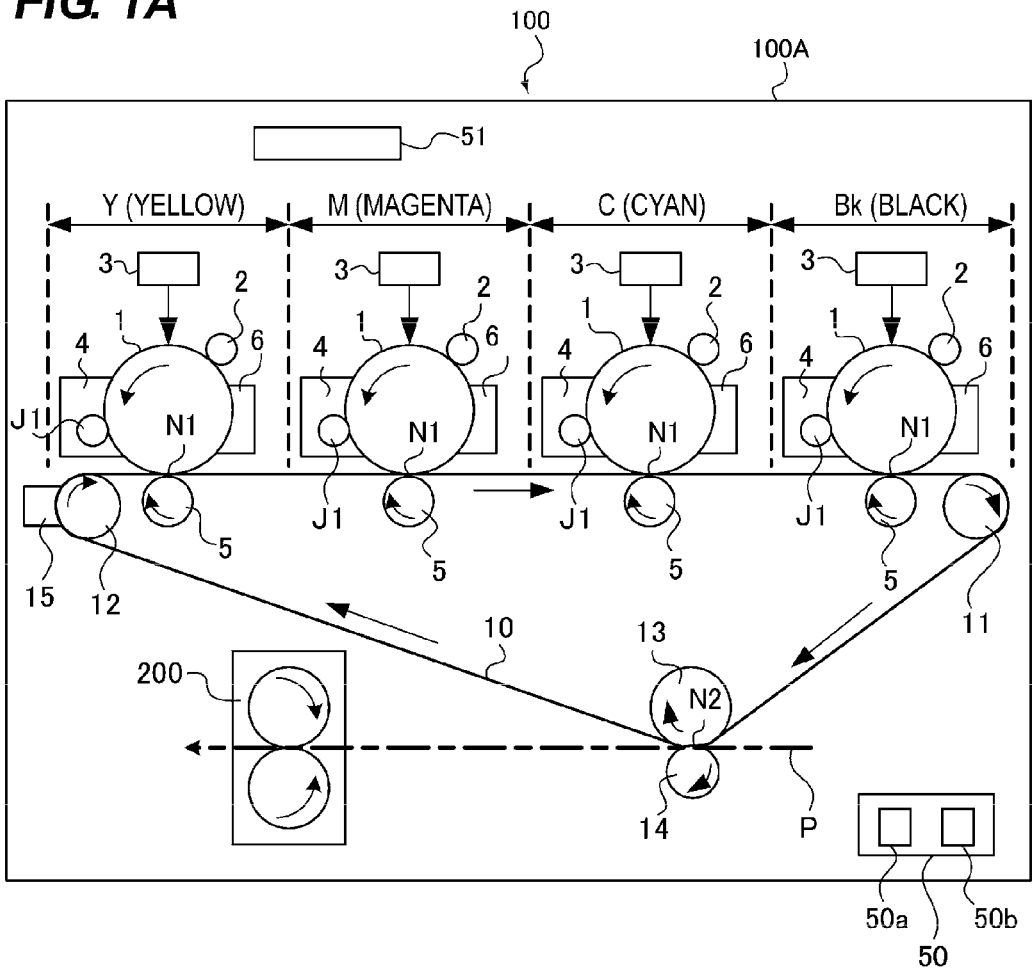
FIG. 1A is a cross-sectional diagram illustrating an image forming apparatus according to a first embodiment.

Hereinafter, embodiments for embodying the present invention will be exemplarily in detail with reference to the drawings. However, dimensions, materials, shapes, and relative positions of components disclosed in the embodiments can be appropriately modified according to a configuration or various conditions of an apparatus to which the invention is to be applied. Therefore, as long as there is no specific description, the scope of the invention is not intended to be limited thereto. In addition, in the configuration of the latter-described embodiment, the same components as those of the former-described embodiment are denoted by the same reference numerals, and it is assumed that the description of the former-described embodiment is incorporated.

First Embodiment

FIG. 1A is a cross-sectional diagram illustrating an image forming apparatus 100 according to a first embodiment. As illustrated in FIG. 1A, the image forming apparatus 100 is configured to include an apparatus main body 100A. Four image forming units Y (yellow), M (magenta), C (cyan), and Bk (black) are disposed inside the apparatus main body 100A. Photosensitive drums 1 are disposed in the respective image forming units Y, M, C, and Bk. A charging device 2, an exposing device 3, a developing device 4, a primary transfer roller 5, and a cleaning device 6 are disposed in this order around each of the photosensitive drums 1 as "image bearing members". In addition, in FIG. 1A, reference numerals of individual devices or members are attached with subscripts of Y, M, C, and Bk. However, theses subscripts may be omitted in the following sentences for the convenience of description.

The charging device 2 is configured to include a charging roller charging the surface of the photosensitive drum 1. The exposing device 3 exposes the surface of the photosensitive drum 1 to form an electrostatic image. The developing device 4 is configured to include a developing roller J1 as a "developer bearing member" facing the photosensitive drum 1 to bear a developer and to develop the electrostatic image of the surface of the photosensitive drum 1 with the developer. The driving device 51 as a "driving portion" drives the developing roller J1.

The controller 50 is configured to include a speed control circuit 50*a* and an efficiency control circuit 50*b*. The speed control circuit 50*a* as a "speed controller" controls a speed ratio of the driving speed of the developing roller J1 to the driving speed of the photosensitive drum 1. The efficiency control circuit 50*b* as an "efficiency controller" controls a developing efficiency by an electric field at the time of developing an electrostatic image of the photosensitive drum 1 with the developer of the developing roller J1. The controller 50 changes the driving speed of the developing roller J1 controlled by the speed control circuit 50*a* and the developing bias (developing efficiency by the electric field) controlled by the efficiency control circuit 50*b* controlling the bias applying portion 52 based on the length of the recording material P in the recording material conveying direction L. The efficiency control circuit 50*b* is connected to the bias applying portion 52 applying the developing bias to the developing roller J1 and the developing roller J1.

As described later in detail, in a case where a length of the recording material P in the recording material conveying direction L is a first length, the controller 50 controls the speed ratio of the driving speed of the developing roller J1 to the driving speed of the photosensitive drum 1 to be a first speed ratio and controls the developing bias so that a residual amount per unit area of the developing roller J1 after the developing of the electrostatic image becomes a first developer amount.

In a case where the length of the recording material P in the recording material conveying direction L is a second length larger than the first length, the controller 50 controls the speed ratio of the driving speed of the developing roller J1 to the driving speed of the photosensitive drum 1 to be a second speed ratio larger than the first speed ratio and controls the developing bias so that the residual amount per unit area of the developing roller J1 after the developing of the electrostatic image becomes a second developer amount larger than the first developer amount.

An endless intermediate transfer belt 10 as an intermediate transfer member is disposed under the photosensitive drums 1 inside the image forming units Y, M, C, and Bk. Primary transfer rollers 5 are at positions opposite to the photosensitive drums 1 with the intermediate transfer belt 10 interposed therebetween. The intermediate transfer belt 10 is suspended on a driving roller 11, a supporting roller 12, and a backup roller 13 and is rotated by rotation of the driving roller 11 in the arrow direction while being in contact with the photosensitive drums 1 (1Y, 1M, 1C, and 1Bk) of the four image forming units Y, M, C, and Bk. The intermediate transfer belt 10 as a "transfer device" transfers the image developed by the developing roller J1 to the recording material P.

The image forming operation will be described hereinafter. The surface of the photosensitive drum 1 is uniformly charged by the charging device 2, and an electrostatic image is formed by the exposing device 3, and the electrostatic image is developed with the developer by the developing device 4, so that a developer image is formed. The developer image on the surface of the photosensitive drum 1 is conveyed to the nip N1 between the photosensitive drum 1 and the intermediate transfer belt 10 and is transferred to the surface of the intermediate transfer belt 10. On the surface of the intermediate transfer belt 10, the yellow, magenta, cyan, and black developer images are overlapped to be primarily transferred. After the primary transfer, a residual toner on the surface of the photosensitive drum 1 is cleaned by a blade or a brush to be collected by the cleaning device 6.

On the other hand, a cassette (not illustrated) accommodating the recording material P is disposed in a lower portion of the apparatus main body 100A. The recording material P inside the cassette is conveyed to the nip N2 of the intermediate transfer belt 10 between the secondary transfer roller 14 and the backup roller 13. Next, the developer images overlapped on the surface of the intermediate transfer belt 10 are collectively transferred to the conveyed recording material P.

A fixing device 200 is disposed at the left side of a nip N2 inside the apparatus main body 100A. When the recording material P passes through the fixing device 200, the toner image on the surface of the recording material P is heated and pressed by the fixing device 200 to be fixed. By doing so, a full color toner image is formed on the surface of the recording material P. After the secondary transfer, a residual toner on the surface of the intermediate transfer belt 10 is cleaned by a blade or a brush to be collected by a cleaning device 15.

Figure 1B:
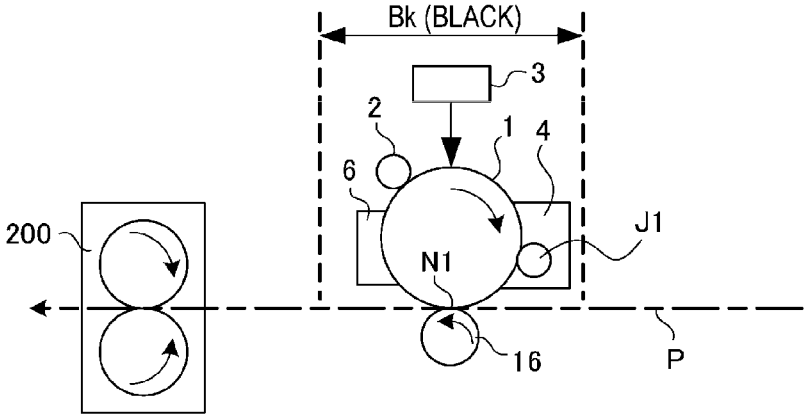
FIG. 1B is a partial enlarged cross-sectional diagram illustrating an image forming apparatus according to a modified embodiment.

FIG. 1B is a partial enlarged cross-sectional diagram illustrating the black image forming unit Bk in the image forming apparatus according to the modified example. In the configuration of FIG. 1B, a recording material conveying roller 16 is disposed at the position facing the image forming unit Bk in the downward direction. The recording material S passes through the nip N of the photosensitive drum 1 and the recording material conveying roller 16 to be conveyed to the fixing device 200. The following embodiments described hereinafter are applied to the image forming apparatus.

Figure 2:
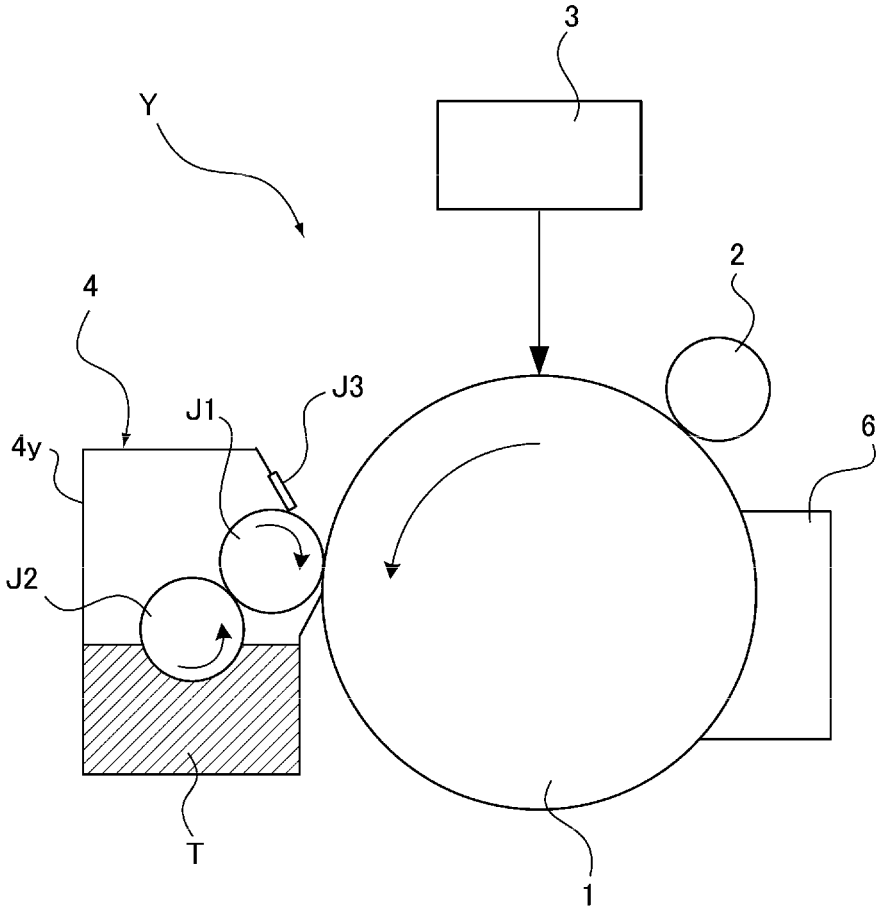
FIG. 2 is a cross-sectional diagram illustrating a yellow image forming unit.

FIG. 2 is a cross-sectional diagram illustrating a yellow image forming unit Y. The image forming unit Y includes a developing device 4. The developing device 4 includes a developing container 4*y*. The developing container 4*y* contains one-component non-magnetic toner T (herein, a minus charged toner of non-magnetic one-component) therein. In addition, the developing container 4*y* includes a developing applying roller J2 and a developing roller J1 therein.

The developing applying roller J2 applies the toner T on the developing roller J1. The developing applying roller J2 is formed in a shape of a sponge, and the developing roller J1 is an elastic roller having elasticity. Herein, the developing roller J1 is formed in a shape of solid rubber. The circumferential speed of the developing applying roller J2 is set to be equal to the circumferential speed of the developing roller J1.

The developing container 4*y* includes a developing blade J3. The developing blade J3 is made of a metal and is disposed in a non-contact manner with respect to the developing roller J1, and the toner T of the surface of the developing roller J1 is regulated to have a uniform thickness. When the developing blade J3 and the toner T are slidingly rubbed with each other, the toner T is electrically charged. Therefore, if the thickness of the toner T of the surface of the developing roller J1 is large, the charging amount of the toner T becomes small. In addition, if the thickness of the toner T of the surface of the developing roller J1 is small, the charging amount of the toner T becomes large. Therefore, in order to obtain a desired charging amount of the toner T, the toner T is set to have a predetermined thickness, and a distance between the developing roller J1 and the developing blade J3 is restricted.

The photosensitive drum 1 and the developing roller J1 are in contact with each other through the toner T. When a DC bias of −400 V is applied to the developing roller J1, a minus-charged toner T is attached to a latent image portion of the surface of the photosensitive drum 1 (potential of exposed portion: about −100 V), so that an yellow toner image is shown. In addition, the charged potential of the surface of the photosensitive drum 1 (potential of non-exposed portion: about −600 V) is obtained. Herein a circumferential speed of the developing roller J1 is set to be about 130% of the circumferential speed of the photosensitive drum 1.

In the image forming apparatus 100, if the photosensitive layer becomes thin due to abrasion of the photosensitive drum 1, charging defect occurs, and thus, an image defect occurs where the toner is attached in a white background portion (non-exposed portion). If the surface roughness becomes rough due to abrasion of the developing roller J1, the surface of the developing roller J1 is unevenly rough, and thus, the thickness of the toner of the surface of the developing roller J1 becomes non-uniform, so that an image defect such as streak or density irregularity occurs.

Therefore, preferably, the circumferential speed of the developing roller J1 and the circumferential speed of the photosensitive drum 1 are set to be substantially equal to each other so that the abrasion of the photosensitive drum 1 and the abrasion of the developing roller J1 become small. However, in recent years, with the speed-up of the image forming apparatus, a desired image density is obtained by setting the circumferential speed of the developing roller J1 to be higher than the circumferential speed of the photosensitive drum 1.

[Case of Normal-Size Recording Material]

Therefore, in order to extend the life cycle of the photosensitive drum 1 and the life cycle of the developing roller J1, the circumferential speed ratio (developing roller circumferential speed ratio) of the developing roller J1 to the photosensitive drum 1 needs to be set to be very small. In other words, the circumferential speed of the developing roller J1 needs to be close to the circumferential speed of the photosensitive drum 1. Therefore, in the embodiment, the developing efficiency by the electric field may be set to be very large, and a speed ratio of the driving speed of the developing roller J1 to the driving speed of the photosensitive drum 1 (hereinafter, sometimes, referred to as a "developing roller circumferential speed ratio") may be set to be small.

[Case of Long Sheet as Recording Material]

However, if the developing efficiency by the electric field is set to be large, a consumed amount of toner of the surface of the developing roller J1 is large. Therefore, in the case of a long sheet, there is no return of the toner amount of the surface of the developing roller J1 between the earlier conveyed recording material P and the later conveyed recording material P. As a result, the toner amount of the surface of the developing roller J1 is insufficient, and thus, the image density in the latter half of the image is lowered. In addition, if the developing efficiency by the electric field is set to be large, all the toner of the surface of the developing roller J1 is replaced with a fresh toner, a charge amount of the toner becomes small. As a result, the developing efficiency by the electric field is lowered, so that the image density is further lowered.

Therefore, in order to stabilize the image density of the long sheet, the developing efficiency by the electric field is set to be small, so that the residual toner on the surface of the developing roller J1 becomes large, and the speed ratio of the driving speed of the developing roller J1 to the driving speed of the photosensitive drum 1 (developing roller circumferential speed ratio) is set to be large. By doing so, a supplied amount of the toner to the developing roller J1 needs to be set to be large.

In addition, if the developing efficiency by the electric field is set to be small, the residual toner amount on the surface of the developing roller J1 after the developing is increased. Therefore, a ratio of the fresh toner amount on the surface of the developing roller J1 is set to be small, so that the lowering of the charge amount of the toner is reduced, and a stabilized charge amount of the toner T can be obtained. As a result, a stabilized image density can be obtained.

TABLE 1

| | A4 Landscape (Length: 0 to 220 mm) | A3 (Length: 221 to 440 mm) | Long sheet (Length: 441 to 1500 mm) |
|---|---|---|---|
| Developing Roller Circumferential Speed Ratio (to Photosensitive | 130% | 140% | 150% |

TABLE 1-continued

| | A4 Landscape (Length: 0 to 220 mm) | A3 (Length: 221 to 440 mm) | Long sheet (Length: 441 to 1500 mm) |
|---|---|---|---|
| Drum) | | | |
| Developing Efficiency by Electric Field | 100% | 90% | 80% |
| Developing Bias | −400 V | −350 V | −300 V |

For example, as listed in Table 1, in A4 landscape printing, the developing roller circumferential speed ratio is set to 130%, and the developing efficiency by the electric field is set to 100%, so that a desired image density can be obtained. In addition, the developing roller circumferential speed ratio is set to be small, and thus, the circumferential speed ratio of the developing roller J1 to the photosensitive drum 1 becomes small, so that the life cycle of the photosensitive drum 1 and the life cycle of the developing roller J1 are extended. In the A4 landscape printing, since the length of the recording material P is small, the returning of the toner amount on the developing roller J1 between the recording materials P occurs at a high frequency. Therefore, although the developing efficiency by the electric field is small and the developing roller circumferential speed ratio is small, without lowering of the image density in the latter half, the image density is stabilized.

In addition, in the embodiment, in order to set the developing efficiency by the electric field to 100%, the developing bias to be applied to the developing roller J1 is set to −400 V, and a difference (developing contrast) from a potential of −100 V of the exposed portion on the photosensitive drum 1 becomes 300 V.

In A3 printing, the developing roller circumferential speed ratio is set to 140%, and the developing efficiency by the electric field is set to 90%, so that a desired image density can be obtained. In addition, the developing roller circumferential speed ratio is set to be at a medium degree, so that the life cycle of the photosensitive drum 1 and the life cycle of the developing roller J1 can be shortened at a medium degree. In the A3 printing, since the length of the recording material P is at a medium degree, the returning of the toner amount on the developing roller J1 between the recording materials P occurs at a medium frequency. Therefore, although the developing roller circumferential speed ratio is not set to be as large as the long sheet, without lowering of the image density in the latter half of the image, the image density is stabilized.

In addition, in the embodiment, in order to set the developing efficiency by the electric field to 90%, the developing bias is set to −350 V, and thus, the difference (developing contrast) from the potential of −100 V of the exposed portion on the photosensitive drum 1 is set to 250 V. By doing so, the developing contrast is lower by 50 V than the developing contrast of 300 V in the A4 landscape printing, so that the developing efficiency by the electric field is lowered.

In long sheet printing (for example, in the case of a long sheet of which the length is in a range of 900 mm to 1200 mm), the developing roller circumferential speed ratio is set to 150%, and the developing efficiency by the electric field is set to 80%, so that a desired image density is obtained and the developing roller circumferential speed ratio is set to be large. By doing so, without lowering of the image density in the latter half of the image, the image density stability of the long sheet can be maintained.

In the long sheet printing, since the length of the recording material P is large, the returning of the toner amount on the developing roller J1 between the recording materials P occurs at a low frequency. Therefore, the developing roller circumferential speed ratio is set to be large, so that the supplied amount of the toner to the developing roller J1 is increased. Furthermore, by lowering the developing efficiency by the electric field, the consumed amount of the toner is decreased, that is, by increasing the after-developing residual toner amount on the developing roller J1, insufficiency of the toner on the developing roller J1 is prevented, so that the image density in the recording material P can be stabilized. However, in comparison with the A4 landscape printing, the long sheet printing where the developing roller circumferential speed ratio is set to be large has a demerit in that the life cycle of the photosensitive drum 1 or the developing roller J1 is lowered down to about 70%.

In addition, in the embodiment, in order to set the developing efficiency by the electric field to 80%, the developing bias is set to −300 V, and thus, the difference (developing contrast) from the potential of −100 V of the exposed portion on the photosensitive drum 1 is set to 200 V. By doing so, the developing contrast is lower by 100 V than the developing contrast of 300 V in the A4 landscape printing, so that the developing efficiency by the electric field is lowered.

Herein, the state where the developing efficiency by the electric field is 100% denotes the state where, in a case where a solid image is developed, almost all the toner (about 100%) on the developing roller J1 is developed on the photosensitive drum 1, and thus, there is almost no after-developing residual toner (0%) on the photosensitive drum 1. In addition, the state where the developing efficiency is 80% denotes the state where, in a case where a solid image is developed, about 80% of the toner on the developing roller J1 is developed on the photosensitive drum 1, and thus, the after-developing residual toner on the photosensitive drum 1 is about 20%.

If the length of the recording material P in the recording material conveying direction L is replaced from the first length to the second length larger than the first length, the controller 50 may control the developing efficiency to be lowered, for example, from 100% to 80%, as follows. Namely, if the length of the recording material P in the recording material conveying direction L is replaced from the first length to the second length larger than the first length, the controller 50 controls the developing bias so that the residual amount per unit area of the developing roller J1 after the developing of the electrostatic image is increased from the first developer amount (0% state) to the second developer amount (20% state) larger than the first developer amount.

In the above-described configuration, by changing the developing bias, the developing contrast is changed, so that the ratio (developing efficiency) by which the toner on the developing roller J1 is developed on the photosensitive drum 1 is changed. Namely, the efficiency control circuit **50*b* controls the bias applying portion 52 to change the developing bias to be applied to the developing roller J1, so that the developing efficiency by which the toner born in the developing roller J1 is developed on the photosensitive drum 1 is controlled according to the electric field between the developing roller J1 and the photosensitive drum 1. Herein, the developing efficiency denotes the residual amount per unit area of the developing roller J1 after the developing of the electrostatic image on the photosensitive drum 1**.

As described above, as the length of the recording material P in the recording material conveying direction is increased, the controller 50 sets the speed ratio of the driving speed of the developing roller J1 to the driving speed of the photosensitive drum 1 controlled by the speed control circuit 50*a* to be large. In addition, as the length of the recording material P in the recording material conveying direction is increased, the controller 50 lowers the developing efficiency by the electric field controlled by the efficiency control circuit 50*b*. Namely, in the case of a long sheet, the developing roller circumferential speed ratio is set to be increased, and the developing efficiency by the electric field is set to be lowered. By doing so, the supplied amount of the toner to the developing roller J1 is increased, and the after-developing residual toner of the developing roller J1 is increased. As a result, the lowering of the image density is reduced, and the image density stability can be maintained.

Furthermore, in a case where only the developing roller circumferential speed ratio is set to be increased, the image density is increased, there is a problem in that the image density varies with the sheet size. Therefore, by setting the developing roller circumferential speed ratio to be increased and setting the developing efficiency by the electric field to be lowered, the developed toner amount on the photosensitive drum 1 can be made constant irrespective of the sheet size, and in other words, the image density can be made constant as a predetermined density.

Therefore, by changing the developing roller circumferential speed ratio and the developing efficiency by the electric field according to the sheet size, with respect to a short recording material P, the life cycle of the photosensitive drum 1 or the developing roller J1 can be extended. In addition, with respect to a long recording material P, the image density stability can be secured. Furthermore, irrespective of the length of the recording material P, a predetermined image density can be obtained.

In the embodiment, the efficiency control circuit 50*b* performs adjustment of changing the setting of the developing bias to be applied to the developing roller J1 to control the developing efficiency by the electric field. Alternatively, the efficiency control circuit 50*b* may perform adjustment of changing a setting of a charging bias for the charging device 2 charging the photosensitive drum (a setting of a charging potential or a setting of a potential of non-exposed portion) to control the developing efficiency by the electric field. In addition, the efficiency control circuit 50*b* may perform adjustment of changing a setting of an exposure quantity for the exposing device 3 exposing the photosensitive drum 1 (a setting of an image signal or a setting of a potential of exposed portion) to control the developing efficiency by the electric field.

In this manner, the efficiency control circuit 50*b* may perform adjustment including at least one (one or a plurality) of the setting of the developing bias, the setting of the charging bias, and the setting of the exposure quantity to control the developing efficiency by the electric field (residual amount per unit area of the developing roller J1 after the developing of the electrostatic image) controlled by the efficiency control circuit 50*b*.

In the embodiment, since the DC bias is applied to the developing roller J1, a value of the DC bias is changed. However, for example, in a case where a bias obtained by overlapping an AC bias to a DC bias is applied to the developing roller J1, by adjusting the value of the DC bias, a Vpp value of the AC bias, or a frequency of the AC bias, the developing efficiency by the electric field can be changed.

In addition, by changing the charging bias of the charging device 2, a charging potential of the photosensitive drum 1 (potential of non-exposed portion) is changed. Therefore, the developing efficiency by the electric field can be changed.

For example, if the embodiment is exemplified, the developing bias of −400 V and the exposure quantity are set to be fixed, and in the A4 landscape printing, the charging potential of the photosensitive drum 1 (potential of non-exposed portion) by the charging bias is −600 V, the potential of exposed portion is −100 V, and the developing contrast is 300 V. In the A3 printing, by adjusting the value of the charging bias, the charging potential is set to −650 V, and in this case, the potential of exposed portion is −150 V, and the developing contrast is 250 V. In the long sheet printing, the charging potential is set to −700 V, and in this case, the potential of exposed portion is −200 V, and the developing contrast is 200 V.

In addition, by changing the exposure quantity on the photosensitive drum 1 (for example, laser power), the potential of exposed portion is changed. Therefore, the developing efficiency by the electric field can be changed.

For example, if the embodiment is exemplified, the developing bias of −400 V and the charging potential of −600 V are fixed, and in the A4 landscape printing, the potential of exposed portion is −100 V, and the developing contrast is 300 V. In the A3 printing, by decreasing the exposure quantity, the potential of exposed portion is set to −150 V, and in this case, the developing contrast becomes 250 V. In the long sheet printing, by further decreasing the exposure quantity, the potential of exposed portion is set to −200 V, and in this case, the developing contrast becomes 200 V.

In addition, by setting the exposure quantity (for example, laser power) to be constant, the developing efficiency can changed with the image signal setting. This is pulse width modulation which is referred to as PWM and denotes dividing an exposure time and adjusting an exposure ON time. The developing efficiency by the electric field may also be changed by adjusting the pulse width modulation, adjusting the macro-exposure quantity on the photosensitive drum 1, and adjusting the potential of exposed portion as described above.

If the above-described long sheet setting is applied to all the sizes of the recording materials P, with respect to all the sizes of the recording materials P, without lowering of the density in the latter half of the image, the density stability of the solid image can be secured.

However, in such a setting, since the life cycle of the photosensitive drum 1 or the developing roller J1 is lowered down to about 70%, even in the case of the A4-size sheet which is normally used, the life cycle is shortened.

Therefore, in the embodiment, by changing the developing roller circumferential speed ratio and the developing efficiency by the electric field according to the sheet size, in the case of the A4-size sheet which is normally used, the life cycle of the photosensitive drum 1 or the developing roller J1 is extended. In addition, in the case of the long sheet which is used at a low use frequency or is used by a specific user, the life cycle of the photosensitive drum 1 or the developing roller J1 is shortened. However, by a configuration where the image quality, that is, the image density stability is maintained by priority, it is possible to provide an image forming apparatus of which the life cycle and the image quality are compatible with each other.

Figure 3:
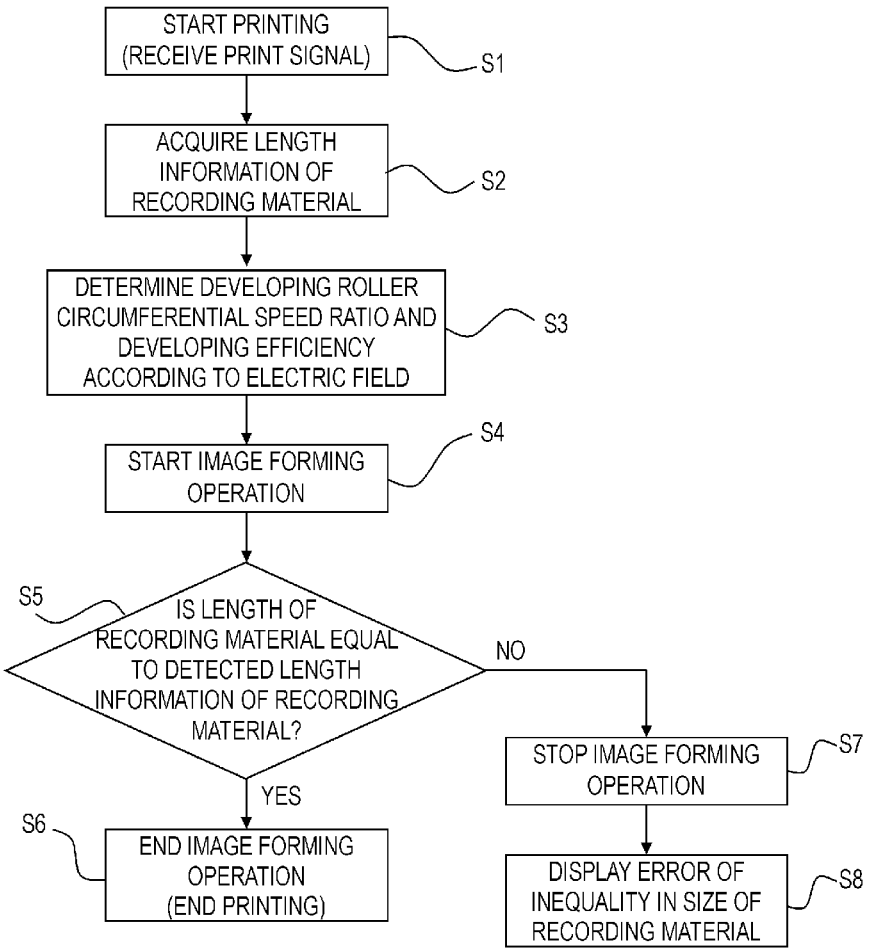
FIG. 3 is a flowchart illustrating a control process of a controller.

FIG. 3 is a flowchart illustrating a control process of the controller 50. The controller 50 receives a print signal from a personal computer or an image reading apparatus (scanner) (not illustrated) and starts printing (S1). The controller 50 acquires length (size) information of the recording material P from the print signal (S2). The controller 50 determines the developing efficiency by the electric field and the developing roller circumferential speed ratio from the length of the recording material P based on Table 1 (S3). The controller 50 starts the image forming operation (S4) to repeat operations of charging, developing, feeding of the recording material P, transferring, cleaning, fixing, and ejecting of the recording material P, so that the image is formed on the recording material P.

The controller 50 determines whether the length information of the recording material P (S2) and the length of the recording material P on which actual image forming is performed are equal to each other (S5). In a case where the result of S5 is Yes, the controller 50 continues to perform the image forming operation, and the image forming operation is ended, so that the printing is ended (S6).

In a case where the result of S5 is No, the controller 50 stops the image forming apparatus (S7) and displays inequality in length of the recording material P as an error on a display device (not illustrated) of the image forming apparatus 100 (S8). By doing so, the user is allowed to facilitate replacing the recording material P or changing the image information (size information of the recording material P). In S7, when the image forming operation is stopped, the conveying of the recording material P may be configured to be stopped. However, the user is requested to perform a task of removing the recording material P inside the apparatus main body 100A. Therefore, as a preferable configuration, the image forming operation excluding the conveying of the recording material P is stopped, and the recording material P is ejected to the outside of the apparatus main body 100A.

As a method of detecting the actual length of the recording material P in S5, for example, a mechanical sensor is disposed on the conveying path of the recording material P to measure a passing time of the recording material P to detect the length of the recording material P. In a typical image forming apparatus, since the length of the recording material P is detected by the above-mentioned method, any detection device needs not to be added for the embodiment.

[Task Combination]

In a case where print signals (tasks) of the image forming operations for the recording materials P of which the lengths are different are consecutively input to the image forming apparatus, in an image forming apparatus of the related art, the tasks are combined, and without stopping of the image forming apparatus between the tasks, the image forming operations for the recording materials P of which the lengths are different are consecutively performed.

However, in the embodiment, the developing roller circumferential speed ratio and the developing efficiency by the electric field need to be determined according to the length of the recording material P. Therefore, in a case where the tasks for the recording materials P of which the lengths are different are input to the image forming apparatus, and the developing roller circumferential speed ratio and the developing efficiency by the electric field need to be changed according to the length of the recording material P, the task combination is not performed. Therefore, the image forming apparatus is stopped once between the tasks, and the flowchart of FIG. 3 needs to be performed. However, in this case, in comparison with the related art, since a temporary stop operation (pre-rotation and post-rotation) is inserted, there is a problem in that the productivity is lowered.

In this case, when the productivity is preferentially maintained, for example, when the task for a long recording material P is performed after the task for a short recording material P, the lowering of the image density occurs. Therefore, the task combination is not performed, and a temporary stop operation is inserted between the tasks, so that the developing roller circumferential speed ratio and the developing efficiency by the electric field are changed.

On the other hand, when the task for the short recording material P is performed after the task for the long recording material P, there does not occur the problem in the image quality. Therefore, the task combination is performed, and the developing roller circumferential speed ratio and the developing efficiency by the electric field are not changed. Therefore, more preferably, in the state where the developing roller circumferential speed ratio and the developing efficiency by the electric field for the long recording material P are maintained, without insertion of the temporary stop operation, by consecutively performing the printing of the task for the short recording material P, the productivity can be improved.

In other words, this can be described as follows. In the case of mixed printing where the lengths in the recording material conveying direction are different, the controller 50 performs control as follows. If the recording material P of which the length in the recording material conveying direction is a predetermined length is conveyed, the controller 50 performs image forming with the speed ratio of the driving speed of the developing roller J1 to the driving speed of the photosensitive drum 1 controlled by the speed control circuit 50*a* and the developing efficiency by the electric field controlled by the efficiency control circuit 50*b* corresponding to the recording material P having the predetermined length. In addition, even if the recording material P of which the length in the recording material conveying direction is smaller than the predetermined length is conveyed, the controller 50 performs image forming without changing the speed ratio of the developing roller J1 to the photosensitive drum 1 and the developing efficiency by the electric field corresponding to the recording material P having the predetermined length.

For the better understanding, this may be described as follows. In the case of the mixed printing where the lengths in the recording material conveying direction are different (in a case where the recording material P of which the length in the recording material conveying direction L is a first length and the recording material P of which the length in the recording material conveying direction L is a second length are alternately printed), the controller 50 performs control as follows. In any one of the case of printing the recording material of which the length in the recording material conveying direction L is the first length and the case of printing the recording material P of which the length in the recording material conveying direction L is the second length, the controller 50 sets the speed ratio of the driving speed of the developing roller J1 to the driving speed of the photosensitive drum 1 to a second speed ratio and controls the developing bias so that the residual amount per unit area of the developing roller J1 after the developing of the electrostatic image becomes a second developer amount.

However, in this case, although the productivity is improved, since the large circumferential speed ratio for the developing roller J1 is also used for the short recording material P, there is a demerit in that the life cycle is shortened.

In addition, within a range where the developing roller circumferential speed ratio and the developing efficiency by the electric field are not changed, with respect to the tasks for the recording materials P of which the lengths are different, the task combination is performed, and without the insertion of the temporary stop operation, the printing of the tasks for the recording materials P of which the lengths are different is consecutively performed. By doing so, the productivity can be improved, and any problem does not occur.

Second Embodiment

In a second embodiment, the controller 50 changes the speed ratio of the driving speed of the developing roller J1 to the driving speed of the photosensitive drum 1 controlled by the speed control circuit 50*a* and the developing efficiency by the electric field controlled by the efficiency control circuit 50*b* based on the density adjustment mode. In addition to this, similarly to the first embodiment, the controller performs control so that the developing roller circumferential speed ratio and the developing efficiency by the electric field are changed based on the length of the recording material P.

In the controller 50, a "standard mode" is initially set. In the standard mode, vermilion or yellowish read a color where yellow is set to 100% and magenta is set to be in a range of 80 to 90%. Red indicating new blood is a color where magenta is set to 100% and yellow is set to be in a range of 80 to 90%.

In some cases, in a manipulation panel, a "high density mode" is designated by the user. As an example, a case where a color called "golden red" is required in POP advertisement will be described. In the JIS color standard, the golden red is "vivid yellowish red". In color designation for printing, the color is obtained by multiplying magenta and yellow by 100%. In addition, since it is difficult to output the color of golden red in the standard mode of the developing, the high density (POP) mode of increasing the toner amount on the photosensitive drum 1 is required.

Therefore, in the embodiment, in the high density mode, in order to allow the high image density, the life cycle of the photosensitive drum 1 or the developing roller J1, and the density stability of the solid image of the long sheet to be compatible with one another, the developing efficiency by the electric field and the developing roller circumferential speed ratio are changed according to the density adjustment mode and the length of the recording material P.

TABLE 2

| | | A4 Landscape (Length: 0 to 220 mm) | A3 (Length: 221 to 440 mm) | Long sheet (Length: 441 to 1500 mm) |
|---|---|---|---|---|
| Standard Mode | Developing Roller Circumferential Speed Ratio (to Photosensitive Drum) | 130% | 140% | 150% |
| | Developing Efficiency by Electric Field | 100% | 90% | 80% |
| | Developing Bias | −400 V | −350 V | −300 V |
| High Density (POP) Mode | Developing Roller Circumferential Speed Ratio (to Photosensitive Drum) | 140% | 150% | 160% |
| | Developing Efficiency by Electric Field | 100% | 90% | 80% |
| | Developing Bias | −400 V | −350V | −300V |

For example, as listed in Table 2, in the period of the standard mode, the developing roller circumferential speed ratio, the developing efficiency by the electric field, the value of the developing bias for achieving the developing efficiency by the electric field are the same as those of Table 1 of the first embodiment.

As listed in Table 2, in the period of the high density mode, each developing roller circumferential speed ratio is increased by 10% according to the length of the recording material P, so that the developing roller circumferential speed ratios are set to 140%, 150%, and 160%. Herein, the density adjustment mode includes a first mode (for example, the standard mode) where the image formed on the recording material is specified by a predetermined applied amount and a second mode (for example, the high density mode where the density is higher than that of the standard mode) where the image formed on the recording material is specified by an applied amount larger than the predetermined applied amount. In this case, the controller 50 sets the speed ratio of the driving speed of the developing roller J1 to the driving speed of the photosensitive drum 1 controlled by the speed control circuit 50*a* to be larger in the second mode (high density mode) than the first mode (for example, the standard mode). In addition, in a case where the density adjustment mode is a third mode (for example, a sub-standard mode) where the image formed on the recording material is specified by an applied amount less than the predetermined applied amount, the setting may be made similarly to the first mode.

Namely, in a case where the lengths of the recording materials P in the recording material conveying direction L are the same, the controller 50 performs control as follows. In the case of performing the first mode, the controller 50 controls the speed ratio of the driving speed of the developing roller J1 to the driving speed of the photosensitive drum 1 to a first speed ratio. In the case of performing the second mode, the controller 50 controls the speed ratio of the driving speed of the developer bearing member to the driving speed of the image bearing member to a second speed ratio larger than the first speed ratio.

Simply speaking, if the user designates the high density mode of the golden red, the controller 50 increases the developing roller circumferential speed ratio to allow the toner applied amount of the photosensitive drum 1 to be larger than that of the standard mode, so that the image of the golden red is formed. In the above-described standard mode, a total of 180 to 190% of the toner of yellow and magenta is required for the "vermilion. In the high density mode, a total of 200% of the toner of yellow and magenta is required for the "golden red". A difference of 10 to 20% of the toner between the two modes is developed on the photosensitive drum 1 by increasing the developing roller circumferential speed ratio.

According to the embodiment, a higher image density, that is, golden red can be implemented, and with respect to a solid image of a long sheet, without occurrence of lowering of the density in the latter half of the recording material P, a stabilized image density can be obtained.

In the high density mode, the high image density can be obtained. However, since the developing roller circumferential speed ratio is increased, in comparison with the standard mode, the high density mode has a demerit in that the life cycle of the photosensitive drum 1 or the developing roller J1 is lowered by about 10%. However, in the high density mode, since the developing roller circumferential speed ratio is smaller than that of the long sheet, there is a merit in that the life cycle in the period of the A4 landscape printing can be extended in comparison with the life cycle in the period of the long sheet printing.

Third Embodiment

In a third embodiment, the controller 50 changes the speed ratio of the driving speed of the developing roller J1 to the driving speed of the photosensitive drum 1 controlled by the speed control circuit 50*a* and the developing efficiency by the electric field controlled by the efficiency control circuit 50*b* based on a type of the recording material P. In addition to this, similarly to the first embodiment, the controller performs control so that the developing roller circumferential speed ratio and the developing efficiency by the electric field are changed based on the length of the recording material P.

For example, in comparison with a plain paper (60 to 100 g/m$^2$) or a rough sheet (recording material P of which the surface roughness is rough), in a thick sheet (150 g/m$^2$ or more), the image density is high, and the line width is thick, so that a vivid character image cannot be obtained. This is because the thick sheet is strongly pressed on the intermediate transfer belt 10 or the photosensitive drum 1 in the period of the transferring of the toner to the recording material P for a rigidity or a thickness of the thick sheet. In addition, this is also because the thick sheet is better than the plain paper in terms of a property of transferring the toner to the recording material P.

In addition, similarly, in a gloss coated sheet, the image density is high, and the line width is thick, so that a vivid character image cannot be obtained. The reason is as follows. In the plain paper or the rough sheet, the toner is infiltrated into sheet fiber, and the toner amount on the surface of convex portions of the sheet fiber is small, and thus, the sheet fiber in the base is seen through, so that the image density is low. Since unevenness occurs on the surface of the toner, the toner glossiness is also low. On the other hand, in the gloss coated sheet, since the surface of the sheet is very smooth, the toner thickness is uniform, and the surface of the toner is smooth. Therefore, the image density is high, and the toner glossiness is also high.

Furthermore, in a color image forming apparatus, since light transmittance of a transparent film for an OHP (overhead projector) is allowed to be increased, preferably, the toner amount on the film may be decreased.

Therefore, in comparison with the plain paper, with respect to the thick sheet, by decreasing the toner amount on the photosensitive drum 1 and decreasing the toner amount on the thick sheet to be smaller than that of the plain paper, the image density and line width equivalent to those of the plain paper can be obtained. Therefore, in a case where the lengths of the recording materials P in the recording material conveying direction L are the same, as the thickness of the recording material P is large, the controller 50 sets the speed ratio of the driving speed of the developing roller J1 to the driving speed of the photosensitive drum 1 controlled by the speed control circuit 50*a* to be small and sets the developing efficiency by the electric field controlled by the efficiency control circuit 50*b* to be small (sets the residual amount per unit area of the developing roller J1 after the developing of the electrostatic image to be large).

In addition, in comparison with the plain paper, with respect to the gloss coated sheet, by decreasing the toner amount on the photosensitive drum 1 and decreasing the toner amount on the gloss coated sheet to be smaller than that of the plain paper, the image density and line width equivalent to those of the plain paper can be obtained. Therefore, in a case where the lengths of the recording materials P in the recording material conveying direction L are the same, as the roughness of the recording material P is smooth, the controller 50 sets the speed ratio of the driving speed of the developing roller J1 to the driving speed of the photosensitive drum 1 controlled by the speed control circuit 50*a* to be small and sets the developing efficiency by the electric field controlled by the efficiency control circuit 50*b* to be small (sets the residual amount per unit area of the developing roller J1 after the developing of the electrostatic image to be large).

Furthermore, in comparison with the plain paper, with respect to the OHP film, by decreasing the toner amount on the photosensitive drum 1 and decreasing the toner amount on the OHP film to be smaller than that of the plain paper, a good transmittance can be obtained. Therefore, in a case where the lengths of the recording materials P in the recording material conveying direction L are the same, as the light transmittance of the recording material is high, the controller 50 sets the speed ratio of the driving speed of the developing roller J1 to the driving speed of the photosensitive drum 1 controlled by the speed control circuit 50*a* to be small and sets the developing efficiency by the electric field controlled by the efficiency control circuit 50*b* to be small (sets the residual amount per unit area of the developing roller J1 after the developing of the electrostatic image to be large).

Therefore, preferably, in comparison with the plain paper, with respect to the thick sheet, the gloss coated sheet, and the OHP film, the toner amount on the photosensitive drum 1 may be lowered.

In view of the described above, in the embodiment, the developing roller circumferential speed ratio and the developing efficiency by the electric field are changed in order to adjust the toner amount on the photosensitive drum 1 according to the type of the recording material P.

TABLE 3

| | | A4 Landscape (Length: 0 to 220 mm) | A3 (Length: 221 to 440 mm) | Long sheet (Length: 441 to 1500 mm) |
|---|---|---|---|---|
| Plain Sheet Rough Sheet | Developing Roller Circumferential Speed Ratio (to Photosensitive Drum) | 130% | 140% | 150% |
| | Developing Efficiency by Electric Field | 100% | 90% | 80% |
| | Developing Bias | −400 V | −350 V | −300 V |
| Thick Sheet Gloss Coated Sheet OHP Film | Developing Roller Circumferential Speed Ratio (to Photosensitive Drum) | 125% | 135% | 145% |
| | Developing Efficiency by Electric Field | 95% | 85% | 75% |
| | Developing Bias | −375 V | −325 V | −257 V |

For example, as listed in Table 3, in the period of printing of the plain paper or the rough sheet, the developing roller circumferential speed ratio, the developing efficiency by the electric field, and the value of the developing bias for achieving the developing efficiency by the electric field are the same as those of Table 1 of the first embodiment.

As listed in Table 3, in the periods of printing of the thick sheet, the gloss coated sheet, and the OHP film, each circumferential speed ratio of the developing roller J1 is decreased by 5% according to the length of the recording material P, so that the circumferential speed ratios of the developing roller J1 are set to 125%, 135%, and 145%. Furthermore, each developing efficiency by the electric field is decreased by 5%, so that the developing efficiencies by the electric field are set to 95%, 85%, and 75%. Therefore, each developing bias is decreased by 25 V, so that the values of the developing bias are set to −375 V, −325 V, and −275 V. And thus, based on the potential of exposed portion of −100 V, the developing contrasts are set to 275 V, 225 V, and 175 V.

Therefore, since the developing roller circumferential speed ratio and the developing contrast are decreased, the toner applied amount on the photosensitive drum 1 is smaller than that of the plain paper. Due to these settings, with respect to the thick sheet or the gloss coated sheet, the image density and line width equivalent to those of the plain paper can be obtained, and a vivid character image can be obtained. With respect to the OHP film, in comparison with the case of printing with the setting of the plain paper of Table 3, in the case of printing with the setting of the OHP film, the light transmittance is improved, and a brighter, vivid projected image in the OHP can be obtained.

Furthermore, in the settings of the thick sheet, the gloss coated sheet, and the OHP film, in comparison with the plain paper, the developing roller circumferential speed ratio and the developing efficiency by the electric field are set to be small. Therefore, the life cycle of the photosensitive drum 1 or the developing roller J1 can be extended, and the density stability of the solid image of the long sheet can be secured.

In addition, in some image forming apparatuses, with respect to the thick sheet, the gloss coated sheet, and the OHP film, for example, the image forming speed may be configured to be a half of that of the plain paper, and in other words, the circumferential speed of the photosensitive drum 1 may be configured to be changed to ½. Even in this case, based on the developing roller circumferential speed ratio corresponding to the circumferential speed of the photosensitive drum 1, the present invention can be applied similarly.

According to any one of the configurations of the first to third embodiments described above, in the case of the A4 landscape printing which is used at a high use frequency, the developing efficiency by the electric field is set to be large, and the driving speed of the developing roller J1 is set to be low. Therefore, a desired density can be obtained. At the same time, the density stability can be improved, and the life cycle of the photosensitive drum 1 or the life cycle of the developing roller J1 can be extended. In addition, compatibility thereof can be implemented.

In contrast, in the case of the long sheet printing which is used at a low use frequency, the developing efficiency by the electric field is set to be small, and the driving speed of the developing roller J1 is set to be high. Therefore, although the life cycle of the photosensitive drum 1 or the life cycle of the developing roller J1 is slightly lowered, the situation where a desired density stability over the entire area of the recording material P can be obtained is implemented.

Therefore, the compatibility of the life cycle of life cycle of the photosensitive drum 1 and or the life cycle of the developing roller J1 in the period of using the normal-size recording material P (A4 landscape sheet or A3 sheet) and the density stability of the solid image in the period of the long sheet can be implemented.

In the first to third embodiments, the developing devices for contact one-component non-magnetic toner are described. However, the embodiments can be applied to a developing device for non-contact two-component non-magnetic toner, and the same effects can be obtained.

In the developing device for non-contact two-component non-magnetic toner, for example, the photosensitive drum 1 and the developing roller J1 have a predetermined interval (gap) so not to be in contact with each other, and as the developing roller J1, generally, a metal roller having a predetermined surface roughness or a roller obtained by coating carbon on a metal roller is used. A developer is configured by mixing a non-magnetic toner and a carrier of a metal powder with a predetermined ratio, applying an AC bias to the developing roller J1 to fly only the toner on the photosensitive drum 1 so that an electrostatic image is developed on the photosensitive drum 1.

In the case of the developing device for the non-contact two-component non-magnetic toner, in the period of solid image printing on the long sheet, similarly to the embodiments, due to the insufficiency of the toner on the developing roller J1, the lowering of the density occurs in the latter half of the image, and thus, the developing roller circumferential speed ratio needs to be increased. However, although the developing roller circumferential speed ratio is increased, since the photosensitive drum 1 and the developing roller J1 are not in contact with each other, the influence to the life cycle of the photosensitive drum 1 is weaker than that of the case of the contact one-component non-magnetic toner.

On the other hand, a mixed material of the toner and the carrier on the developing roller J1 is regulated by a developing blade J3. Therefore, the developing roller J1 is abraded particularly due to slidingly rubbing with the carrier, so that scratches occur in the developing roller J1, the roughness of the developing roller J1 is changed (roughened or smoothened), or a carbon coat is peeled off due to the abrasion. Therefore, the life cycle thereof is shortened.

Therefore, even in the case of the developing device for the non-contact two-component non-magnetic toner, similarly to the embodiments, by changing the developing efficiency by the electric field and the developing roller circumferential speed ratio based on the length of the recording material P, the durability of the developing roller J1 and the density stability of the image of the long sheet can be compatible with each other.

In addition, in the embodiments, all the values are appropriate values for describing the present invention, and thus, the values may be set to be arbitrary.

According to the present invention, an image density of a long sheet is stabilized over the area of from a former half of an image to a latter half of the image, and a life cycle of an image bearing member and a life cycle of a developer bearing member is extended.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-248551, filed Dec. 9, 2014, which is hereby incorporated by reference herein in its entirety.

What is claimed is:

1. An image forming apparatus comprising:

an image bearing member;

a developing device which includes a developer bearing member configured to face the image bearing member and configured to bear a developer and develop an electrostatic image formed on the image bearing member with the developer;

a bias applying portion configured to apply a developing bias to the developer bearing member;

a driving portion configured to drive the developer bearing member;

a transfer device configured to transfer an image developed by the developer bearing member to the recording material; and a controller configured to control a driving speed of the developer bearing member and the developing bias based on a length of the recording material in a recording material conveying direction, wherein, in a case where the length of the recording material in the recording material conveying direction is a first length, the controller controls a speed ratio of the driving speed of the developer bearing member to a driving speed of the image bearing member to be a first speed ratio and controls the developing bias so that a residual developer amount born per unit area of the developer bearing member after the developing of the electrostatic image becomes a first developer amount, and wherein, in a case where the length of the recording material in the recording material conveying direction is a second length larger than the first length, the controller controls the speed ratio of the driving speed of the developer bearing member to the driving speed of the image bearing member to be a second speed ratio larger than the first speed ratio and controls the residual developer amount born per unit area of the developer bearing member after the developing of the electrostatic image becomes a second developer amount larger than the first developer amount.

2. The image forming apparatus according to claim 1, wherein the controller execute a first mode where the image formed on the recording material has a predetermined applied amount and a second mode wherein the image formed on the recording material has an applied amount larger than the predetermined applied amount, and wherein, in a case where the lengths of the recording material in the recording material conveying direction are the same, in the case of executing the first mode, the controller controls the speed ratio of the driving speed of the developer bearing member to the driving speed of the image bearing member to be the first speed ratio, and in the case of executing the second mode, the controller controls the speed ratio of the driving speed of the developer bearing member to the driving speed of the image bearing member to be the second speed ratio larger than the first speed ratio.

3. The image forming apparatus according to claim 1, wherein, in a case where the lengths of the recording material in the recording material conveying direction are the same, as a thickness of the recording material is increased, the controller sets the speed ratio of the driving speed of the developer bearing member to the driving speed of the image bearing member to be small and sets the residual developer amount born per unit area of the developer bearing member after the developing of the electrostatic image to be large.

4. The image forming apparatus according to claim 1, wherein, in a case where the lengths of the recording material in the recording material conveying direction are the same, as a roughness of the recording material is smooth, the controller set the speed ratio of the driving speed of the developer bearing member to the driving speed of the image bearing member to be small and sets the residual developer amount born per unit area of the developer bearing member after the developing of the electrostatic image to be large.

5. The image forming apparatus according to claim 1, wherein, in a case where the lengths of the recording material in the recording material conveying direction are the same, as a light transmittance of the recording material is increased, the controller sets the speed ratio of the driving speed of the developer bearing member to the driving speed of the image bearing member to be small and sets the residual developer amount born per unit area of the developer bearing member after the developing of the electrostatic image to be large.

6. The image forming apparatus according to claim 1, wherein the controller controls the residual developer amount born per unit area of the developer bearing member after the developing of the electrostatic image by adjustment including at least one setting among a setting of a charging bias for the charging device charging the image bearing member, a setting of the developing bias to be applied to the developer bearing member, and a setting of an exposure quantity for the exposing device exposing the image bearing member.

7. The image forming apparatus according to claim 1, wherein the image bearing member and the developer bearing member are in contact with each other through toner, and the toner is one-component non-magnetic toner.

8. The image forming apparatus according to claim 1, wherein the developer bearing member is an elastic roller having elasticity.

9. The image forming apparatus according to claim 1, wherein, in a case where the recording material of which the length in the recording material conveying direction is the first length and recording material of which the length in the recording material conveying direction is the second length are alternately printed, in any one of a case where printing is performed on the recording material of which the length in the recording material conveying direction is the first length and a case where printing is performed on recording material of which the length in the recording material conveying direction is the second length, the controllers controls the speed ratio of the driving speed of the developer bearing member to the driving speed of the image bearing member so that the speed ratio of the driving speed of the developer bearing member to the driving speed of the image bearing member becomes the second speed ratio and controls the developing bias so that the residual developer amount born per unit area of the developer bearing member after the developing of the electrostatic image becomes the second developer amount.

10. An image forming apparatus comprising:

an image bearing member configured to bear a latent image;

a developing device configured to develop the latent image formed on the image bearing member with toner, the developing device having a toner bearing member rotatably supported and configured to bear a toner and develop the latent image formed on the image bearing member with the toner;

a transfer device configured to transfer the toner image on the image bearing member to a recording medium;

a controller configured to execute a first mode for image-forming on the recording medium, which length in a recording medium conveying direction is a first length, and a second mode for image-forming on the recording medium, which length in the recording medium conveying direction is a second length longer than the first length, wherein in a case that the controller executes the first mode, the controller sets a circumferential speed ratio of the toner bearing member against the image bearing member at a first circumferential speed ratio and sets a developing contrast as a difference between DC bias applied to the toner bearing member and electric potential of image portion of the image bearing member at a first contrast, and in a case that the controller executes the second mode, the controller sets the circumferential speed ratio at a second circumferential speed ratio higher than the first circumferential speed ratio and sets the developing contrast at a second contrast smaller than the first contrast.

11. An image forming apparatus comprising:

an image bearing member configured to bear a latent image;

a developing device configured to develop the latent image formed on the image bearing member with toner, the developing device having a toner bearing member rotatably supported and configured to bear a toner and develop the latent image formed on the image bearing member with the toner;

a transfer device configured to transfer the toner image on the image bearing member to a recording medium;

a controller configured to execute a first mode for image-forming on the recording medium, which length in a recording medium conveying direction is a first length, and a second mode for image-forming on the recording medium, which length in the recording medium conveying direction is a second length longer than the first length, wherein in a case that the controller executes the first mode, the controller sets a circumferential speed ratio of the toner bearing member against the image bearing member at a first circumferential speed ratio and sets a developing bias at a first condition, and in a case that the controller executes the second mode, the controller sets the circumferential speed ratio at a second circumferential speed ratio higher than the first circumferential speed ratio and sets the developing bias at a second condition different from the first condition, wherein the second condition is a condition that developing efficiency is lower than the first condition, in a case that all image forming conditions are the same as in the first condition except the developing bias.

12. An image forming apparatus comprising:

an image bearing member configured to bear a latent image;

a rotatable toner bearing member configured to bear a toner and develop the latent image formed on the image bearing member with the toner;

a transfer device configured to transfer the toner image formed on the image bearing member to a recording medium;

a controller configured to execute a first mode for forming a toner image on the recording medium, in which a maximum toner carrying amount per unit area is a first maximum toner carrying amount, and a second mode for forming a toner image on the recording medium, in which the maximum toner carrying amount per unit is a second maximum toner carrying amount larger than the first maximum toner carrying amount, wherein in a case that the controller executes the first mode, the controller sets a circumferential speed ratio of the toner bearing member against the image bearing member at a first circumferential speed ratio, and in a case that the controller executes the second mode, the controller sets the circumferential speed ratio at a second circumferential speed ratio higher than the first circumferential speed ratio, and the controller executes the second mode upon an order of the second mode by an operator.

13. An image forming apparatus according to claim 12, wherein in a case that an image forming job is performed such that the first mode continues after the second mode is executed, the controller sets the circumferential speed ratio at the second circumferential speed ratio in each of the first mode and the second mode.

14. An image forming apparatus according to claim 12, wherein the toner is one-component non-magnetic toner.

15. An image forming apparatus according to claim 12, wherein the toner bearing member bears the toner and a carrier.

16. An image forming apparatus according to claim 12, wherein the toner bearing member contacts with the image bearing member.

17. An image forming apparatus according to claim 12, wherein in the second mode, the image forming apparatus is able to form an image on a recording media which size is equal or larger than 441 mm in a recording medium conveying direction.

18. An image forming apparatus according to claim 12, wherein the second maximum toner carrying amount is larger than the first maximum toner carrying amount by more than 10%.

19. An image forming apparatus according to claim 12, wherein a potential difference between DC voltage applied to the toner bearing member at a time of the first mode and a potential of an image on the image bearing member is executed is different from a potential difference between DC voltage applied to the toner bearing member at a time of the second mode and a potential of an image on the image bearing member.

20. An image forming apparatus according to claim 12, wherein in a case there is no instruction by an operator, the controller executes the first mode.

21. An image forming apparatus according to claim 12, wherein a rotary direction of the image bearing member is opposite to a rotary direction of the toner bearing member.

22. An image forming apparatus comprising:

an image bearing member configured to bear a latent image;

a rotatable toner bearing member configured to bear a toner and develop the latent image formed on the image bearing member with the toner;

a transfer device configured to transfer the toner image formed on the image bearing member to a recording medium;

a controller configured to execute a first mode for forming a toner image on the recording medium, in which a maximum toner carrying amount per unit area is a first maximum toner carrying amount, and a second mode for forming a toner image on the recording medium, in which the maximum toner carrying amount per unit is a second maximum toner carrying amount larger than the first maximum toner carrying amount, wherein in a case that the controller executes the first mode, the controller sets a circumferential speed ratio of the toner bearing member against the image bearing member at a first circumferential speed ratio, and in a case that the controller executes the second mode, the controller sets the circumferential speed ratio at a second circumferential speed ratio higher than the first circumferential speed ratio, wherein in the second mode, the image forming apparatus can form an image on a recording medium equal or larger than 441 mm in a recording medium conveying direction.

23. An image forming apparatus according to claim 22, wherein in a case that an image forming job is performed such that the first mode continues after the second mode is executed, the controller sets the circumferential speed ratio at the second circumferential speed ratio in each of the first mode and the second mode.

24. An image forming apparatus according to claim 22, wherein the toner is one-component non-magnetic toner.

25. An image forming apparatus according to claim 22, wherein the toner bearing member bears the toner and a carrier.

26. An image forming apparatus according to claim 22, wherein the toner bearing member contacts with the image bearing member.

27. An image forming apparatus according to claim 22, wherein the second maximum toner carrying amount is larger than the first maximum toner carrying amount by more than 10%.

28. An image forming apparatus according to claim 22, wherein a potential difference between DC voltage applied to the toner bearing member at a time of the first mode and a potential of an image on the image bearing member is executed is different from a potential difference between DC voltage applied to the toner bearing member at a time of the second mode and a potential of an image on the image bearing member.

29. An image forming apparatus according to claim 22, wherein a rotary direction of the image bearing member is opposite to a rotary direction of the toner bearing member.

30. An image forming apparatus comprising:

an image bearing member configured to bear a latent image;

a rotatable toner bearing member configured to bear a toner and develop the latent image formed on the image bearing member with the toner;

an voltage biasing portion configured to apply DC bias to the rotatable toner bearing member:

a transfer device configured to transfer the toner image formed on the image bearing member to a recording medium;

a controller configured to execute a first mode for forming a toner image on the recording medium, in which a maximum toner carrying amount per unit area is a first maximum toner carrying amount, and a second mode for forming a toner image on the recording medium, in which the maximum toner carrying amount per unit is a second maximum toner carrying amount larger than the first maximum toner carrying amount, wherein in a case that the controller executes the first mode, the controller sets a circumferential speed ratio of the toner bearing member against the image bearing member at a first circumferential speed ratio, and in a case that the controller executes the second mode, the controller sets the circumferential speed ratio at a second circumferential speed ratio higher than the first circumferential speed ratio, wherein a potential difference between DC voltage applied to the toner bearing member at a time of the first mode and a potential of an image on the image bearing member is executed is different from a potential difference between DC voltage applied to the toner bearing member at a time of the second mode and a potential of an image on the image bearing member.

31. An image forming apparatus according to claim 30, wherein in a case that an image forming job is performed such that the first mode continues after the second mode is executed, the controller sets the circumferential speed ratio at the second circumferential speed ratio in each of the first mode and the second mode.

32. An image forming apparatus according to claim 30, wherein the toner is one-component non-magnetic toner.

33. An image forming apparatus according to claim 30, wherein the toner bearing member bears the toner and a carrier.

34. An image forming apparatus according to claim 30, wherein the toner bearing member contacts with the image bearing member.

35. An image forming apparatus according to claim 30, wherein in the second mode, the image forming apparatus is able to form the toner image on a recording medium having a size longer than 441 mm in a conveying direction of the recording medium.

36. An image forming apparatus according to claim 30, wherein the second maximum toner carrying amount is larger than the first maximum toner carrying amount by more than 10%.

37. An image forming apparatus according to claim 30, wherein a rotary direction of the image bearing member is opposite to a rotary direction of the toner bearing member.

38. An image forming apparatus comprising:

an image bearing member configured to bear a latent image;

a rotatable toner bearing member configured to bear a toner and develop the latent image formed on the image bearing member with the toner;

a transfer device configured to transfer the toner image formed on the image bearing member to a recording medium;

a controller configured to execute a first mode for forming a toner image on the recording medium, in which a maximum toner carrying amount per unit area in a case of developing an image by a maximum image density signal input is a first maximum toner carrying amount, and a second mode for forming a toner image on the recording medium, in which the maximum toner carrying amount per unit area in a case of developing an image by a maximum image density signal input is a second maximum toner carrying amount larger than the first maximum toner carrying amount, wherein in a case that the controller executes the first mode, the controller sets a circumferential speed ratio of the toner bearing member against the image bearing member at a first circumferential speed ratio, and in a case that the controller executes the second mode, the controller sets the circumferential speed ratio at a second circumferential speed ratio higher than the first circumferential speed ratio.

39. An image forming apparatus according to claim 38, wherein in a case that an image forming job is performed such that the first mode continues after the second mode is executed, the controller sets the circumferential speed ratio at the second circumferential speed ratio in each of the first mode and the second mode.

40. An image forming apparatus according to claim 38, wherein the toner is one-component non-magnetic toner.

41. An image forming apparatus according to claim 38, wherein the toner bearing member bears toner and carrier.

42. An image forming apparatus according to claim 38, wherein the toner bearing member contacts with the image bearing member.

43. An image forming apparatus according to claim 38, the controller executes the second mode upon an order of the second mode by an operator.

44. An image forming apparatus according to claim 38, wherein in the second mode, the image forming apparatus is able to form an image on a recording media which size is equal or larger than 441 mm in a recording medium conveying direction.

45. An image forming apparatus according to claim 38, wherein the second maximum toner carrying amount is larger than the first maximum toner carrying amount by more than 10%.

46. An image forming apparatus according to claim 38, wherein a potential difference between DC voltage applied to the toner bearing member at a time of the first mode and a potential of an image on the image bearing member is executed is different from a potential difference between DC voltage applied to the toner bearing member at a time of the second mode and a potential of an image on the image bearing member.

47. An image forming apparatus according to claim 38, wherein a rotary direction of the image bearing member is opposite to a rotary direction of the toner bearing member.

* * * * *